US007222816B2

(12) United States Patent
Clark

(10) Patent No.: US 7,222,816 B2
(45) Date of Patent: May 29, 2007

(54) GUIDE ROLLER WITH FLANGES FOR A DISPENSER

(75) Inventor: Gerald Lewis Clark, Nicholson, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/093,651

(22) Filed: Mar. 30, 2005

(65) Prior Publication Data

US 2006/0226277 A1 Oct. 12, 2006

(51) Int. Cl.
*B65H 23/00* (2006.01)

(52) U.S. Cl. ..... 242/566; 242/564.2; 242/615.3

(58) Field of Classification Search ..... 242/566, 242/564.2, 615.3, 129.53
See application file for complete search history.

(56) References Cited

U.S. PATENT DOCUMENTS

| | | | | | |
|---|---|---|---|---|---|
| 2,788,944 | A | * | 4/1957 | Krueger | 242/564.2 |
| 2,824,705 | A | * | 2/1958 | Bowman | 242/566 |
| 3,622,095 | A | * | 11/1971 | Turner | 242/615.3 |
| 4,272,000 | A | * | 6/1981 | Hope et al. | 242/615.3 |
| 4,883,232 | A | * | 11/1989 | Marchetti | 242/566 |
| 5,048,589 | A | | 9/1991 | Cook et al. | |
| 5,399,412 | A | | 3/1995 | Sudall et al. | |
| 5,526,973 | A | * | 6/1996 | Boone et al. | 242/566 |
| 5,674,590 | A | | 10/1997 | Anderson et al. | |
| 5,772,845 | A | | 6/1998 | Farrington, Jr. et al. | |
| 5,904,971 | A | | 5/1999 | Anderson et al. | |
| 6,248,212 | B1 | | 6/2001 | Anderson et al. | |
| 6,273,996 | B1 | | 8/2001 | Hollenberg et al. | |
| 6,314,850 | B1 | | 11/2001 | Morand | |

* cited by examiner

*Primary Examiner*—William A. Rivera
(74) *Attorney, Agent, or Firm*—Sue C. Watson

(57) ABSTRACT

An apparatus adapted for use with a dispenser housing for rolled sheet material to provide reliable dispensing of sheet material therefrom is provided. The apparatus is adapted for a dispenser housing which includes a roll support configured to hold at least one cylindrical roll of sheet material and a dispensing assembly. The dispensing assembly includes an exit port to permit sheet material to be withdrawn therefrom. The cylindrical roll of sheet material is desirably mounted on a portion of the roll support. The roll includes opposing flat surfaces and an outer circumference, the apparatus comprises a guide roller including an elongated central portion positioned between two opposing ends and a flange positioned near each end of the guide roller. The central portion is configured to be positioned adjacent the outer circumference of a roll of sheet material when the roll is a new roll disposed in the dispenser housing. At least a portion of an inner surface of each flange is positioned adjacent a flat surface of the roll of sheet material when the roll is a new roll. The guide roller is positioned such that sheet material flows from the roll between the flanges and over the central portion of the guide roller to the dispensing assembly. The flow of sheet material is aligned on its path to the dispensing assembly such that bunching and jamming of non-aligned sheet material is eliminated. A system is provided as well.

21 Claims, 9 Drawing Sheets

GUIDE ROLLER WITH FLANGES FOR A DISPENSER

BACKGROUND

Institutions and businesses using dispensers of rolled sheet material products in commercial settings depend upon the dispenser to reliably dispense sheet material until the sheet material is depleted. One desirable type of dispenser in such a setting is a "hands free" dispenser. Such a dispenser permits a user to grasp a tail of a sheet material extending from an exit port in the dispenser and to withdraw the sheet of material for use. In this manner, a user is not required to touch the dispenser. When the sheet material in such a dispenser becomes bunched up and jammed within the dispenser, the dispensing mechanism is unable to adequately dispense sheet material to a user, and dispensing failure occurs. Although some dispensers have a rotational device to allow users to dispense such bunched or jammed sheet material, the dispenser must be touched by the user to activate the rotational devise and obtain a sheet of material. This action defeats the purpose of the "hands-free" dispenser, where a user may keep his/her hands free of contamination by avoiding touching a dispenser.

It would be desirable to have an apparatus which prevented bunching, jamming and/or dispensing failure of rolled sheet material in a "hands-free"-type dispenser. Such a device would desirably be simple, but it would also be effective in guiding the sheet material from a roll in an even, aligned and measured manner into and through the dispensing mechanism. Further, such an apparatus would desirably prevent the sheet material from moving transversely from one side to the other within a dispenser housing. Such an apparatus would allow sheet material from a new, full roll of sheet material product as well as from a partially or nearly depleted roll of sheet material product to be dispensed reliably from the dispenser without bunching, jamming and/or dispensing failure.

DEFINITIONS

As used herein, the term "exit port" or "dispensing port" is the opening in a housing of a dispenser for the passage of sheet material out of the dispenser.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

As used herein, the term "about" includes plus or minus 10 percent of the numeral stated at each end of the range.

These terms may be defined with additional language in the remaining portions of the specification.

SUMMARY OF THE INVENTION

In response to the difficulties and problems discussed herein, an apparatus adapted for use with a dispenser housing for rolled sheet material to provide reliable dispensing of sheet material therefrom is provided. The apparatus is adapted for a dispenser housing which includes a roll support configured to hold at least one cylindrical roll of sheet material and a dispensing assembly. The dispensing assembly includes an exit port to permit sheet material to be withdrawn therefrom. The cylindrical roll of sheet material is desirably mounted on a portion of the roll support. The roll includes opposing flat surfaces and an outer circumference, the apparatus comprises a guide roller including an elongated central portion positioned between two opposing ends and a flange positioned near each end of the guide roller. The central portion is configured to be positioned adjacent the outer circumference of a roll of sheet material when the roll is a new roll disposed in the dispenser housing. At least a portion of an inner surface of each flange is positioned adjacent a flat surface of the roll of sheet material when the roll is a new roll. The guide roller is positioned such that sheet material flows from the roll between the flanges and over the central portion of the guide roller to the dispensing assembly. The flow of sheet material is aligned on its path to the dispensing assembly such that bunching and jamming of non-aligned sheet material is eliminated.

In another aspect of the invention, a system adapted for use with a dispenser housing for rolled sheet material to provide reliable dispensing of sheet material therefrom is provided. The system includes a dispenser housing which includes a roll support configured to hold at least one cylindrical roll of sheet material and a dispensing assembly. The dispensing assembly includes an exit port to permit sheet material to be withdrawn from the dispensing assembly and housing. The cylindrical roll of sheet material is desirably mounted on a portion of the roll support. The roll includes opposing flat surfaces and an outer circumference. The system also includes a guide roller positioned between the roll support and the dispensing assembly. The guide roller includes an elongated central portion positioned between two opposing ends and a flange positioned near each end of the guide roller. The central portion is configured to be positioned adjacent the outer circumference of a roll of sheet material when the roll is a new roll disposed in the dispenser housing. At least a portion of an inner surface of each flange is positioned adjacent a flat surface of the roll of sheet material when the roll is a new roll. The guide roller is positioned such that sheet material flows from the roll between the flanges and over the central portion of the guide roller to the dispensing assembly. The flow of sheet material is aligned on its path to the dispensing assembly such that bunching and jamming of non-aligned sheet material is eliminated.

DETAILED DESCRIPTION

Figure 1:
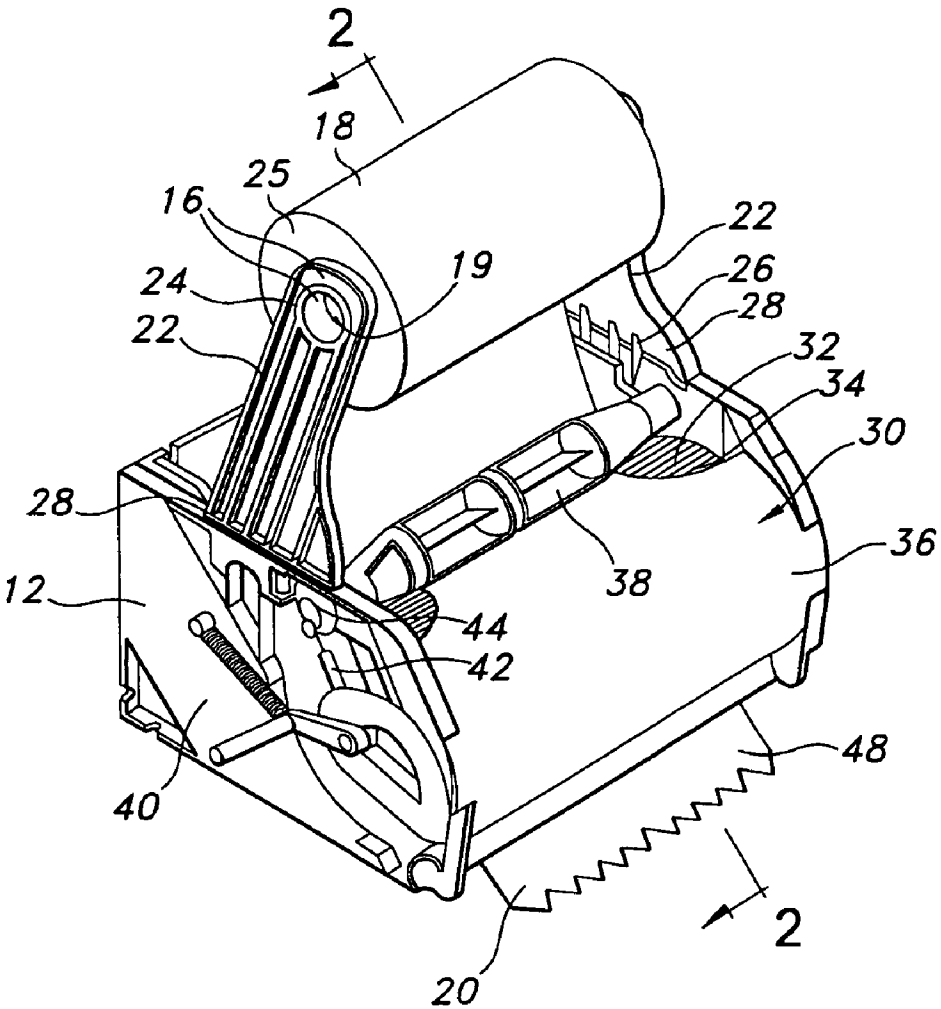
FIG. 1 (PRIOR ART)
FIG. 1 is a perspective view of a prior art dispenser which may be used with the present invention.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Figure 3:
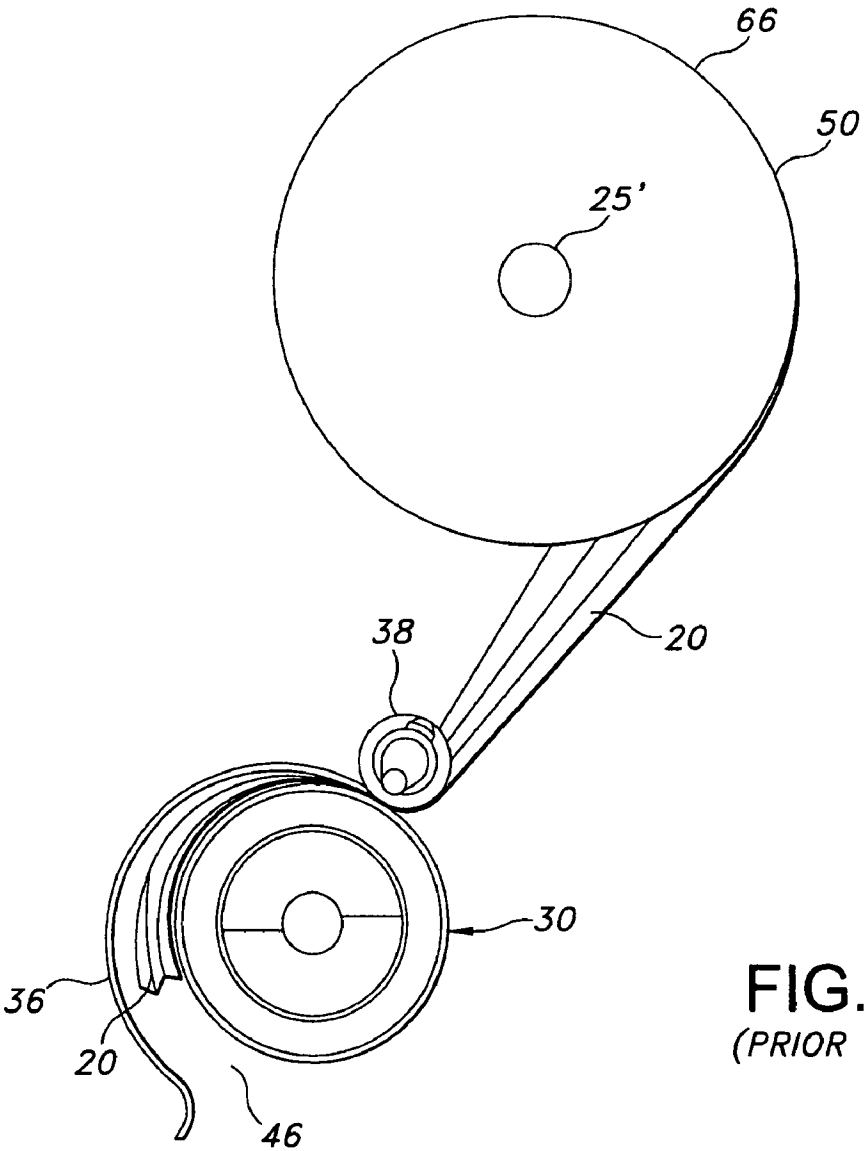
FIG. 3 (PRIOR ART)
FIG. 3 is a schematic cross sectional view similar to FIG. 2, but showing transverse movement of sheet material causing bunching and jamming of sheet material within a dispensing actuator roller assembly.

The present invention provides an apparatus for dispensing rolled material. Such rolled material may include, but is not limited to, woven materials, nonwoven materials, synthetic materials, natural materials, foils, polymer films, any combination thereof, and so forth. Desirably, the rolled material is provided as a sheet material within a roll. Exemplary sheet materials for which the present invention is suitable include, but are not limited to, absorbent sheet materials such as towels, wipers, tissue, and so forth. Suitable sheet materials are disclosed, by way of non-limiting examples only, in U.S. Pat. No. 5,048,589 to Cook et al., U.S. Pat. No. 5,399,412 to Sudall et al., U.S. Pat. No. 5,674,590 to Anderson et al., U.S. Pat. No. 5,772,845 to Farrington, Jr. et al., U.S. Pat. No. 5,904,971 to Anderson et al., U.S. Pat. No. 6,248,212 to Anderson et al., and U.S. Pat. No. 6,273,996 to Hollenberg et al., the entire contents of which are herein incorporated by reference. The sheet materials for which the present invention is suitable may be wound around a core (not shown). Alternatively, as illustrated in FIG. 3, the sheet materials are wound into a coreless roll. The sheet materials for which the present invention is suitable may have regularly spaced zones of weakness extending substantially across the width of the sheet material. The zones of weakness are used to separate or cut the sheet material into individual sheets and may be, for example, defined by a series of perforations, a zone of much lower basis weight, and so forth.

The present invention is desirably used with a dispenser which has a housing or dispensing module. One suitable dispenser having a housing or dispensing module is disclosed, by way of non-limiting examples only, in U.S. Pat. No. 6,314,850 B1 to Morand, the entire contents of which are herein incorporated by reference for all purposes. Other dispensers which are suitable for use with the present invention will be known by those skilled in the art.

Figure 5:
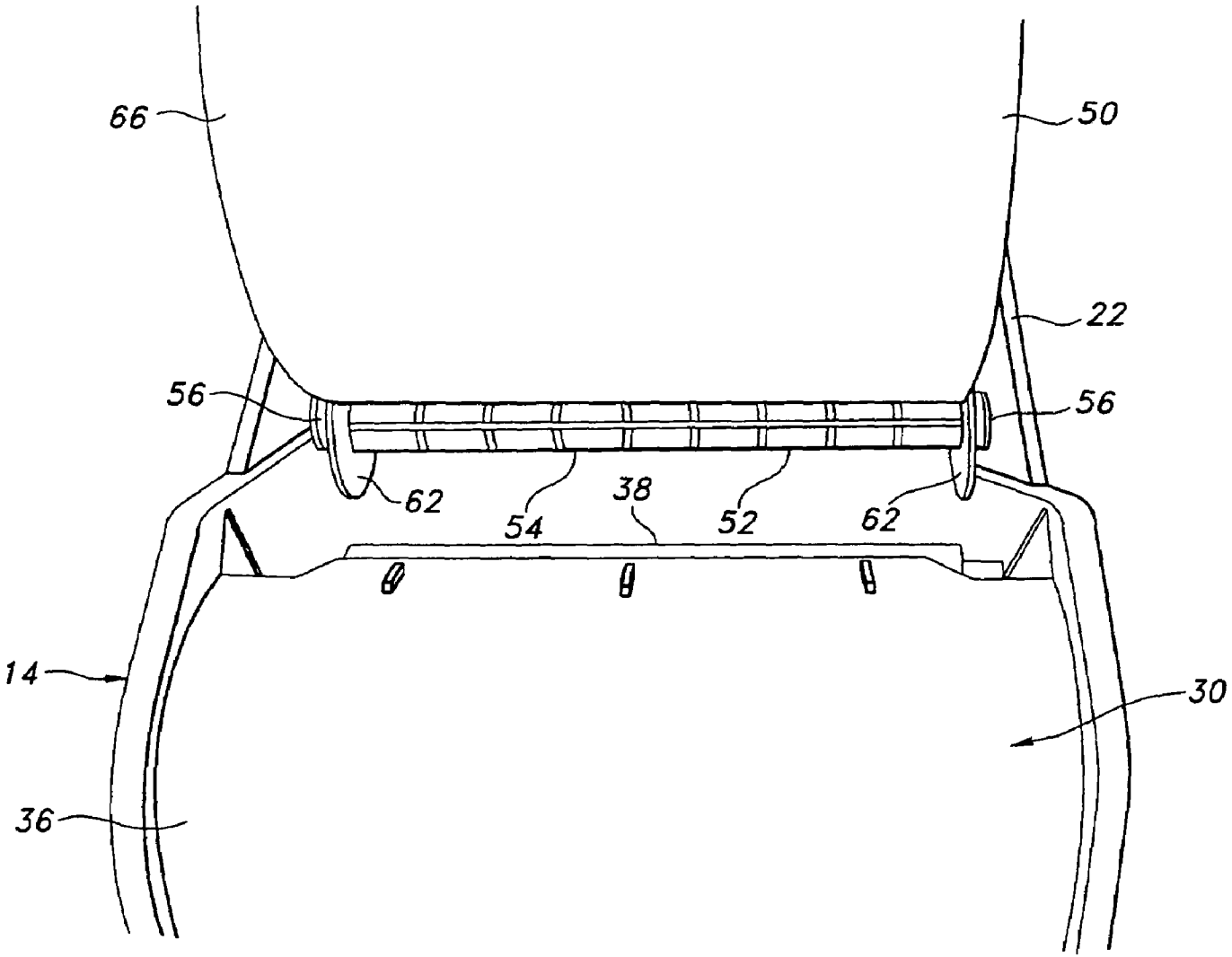
FIG. 5 is a front side view of the guide roller of FIG. 4 positioned in the dispenser of FIG. 1.
Figure 6:
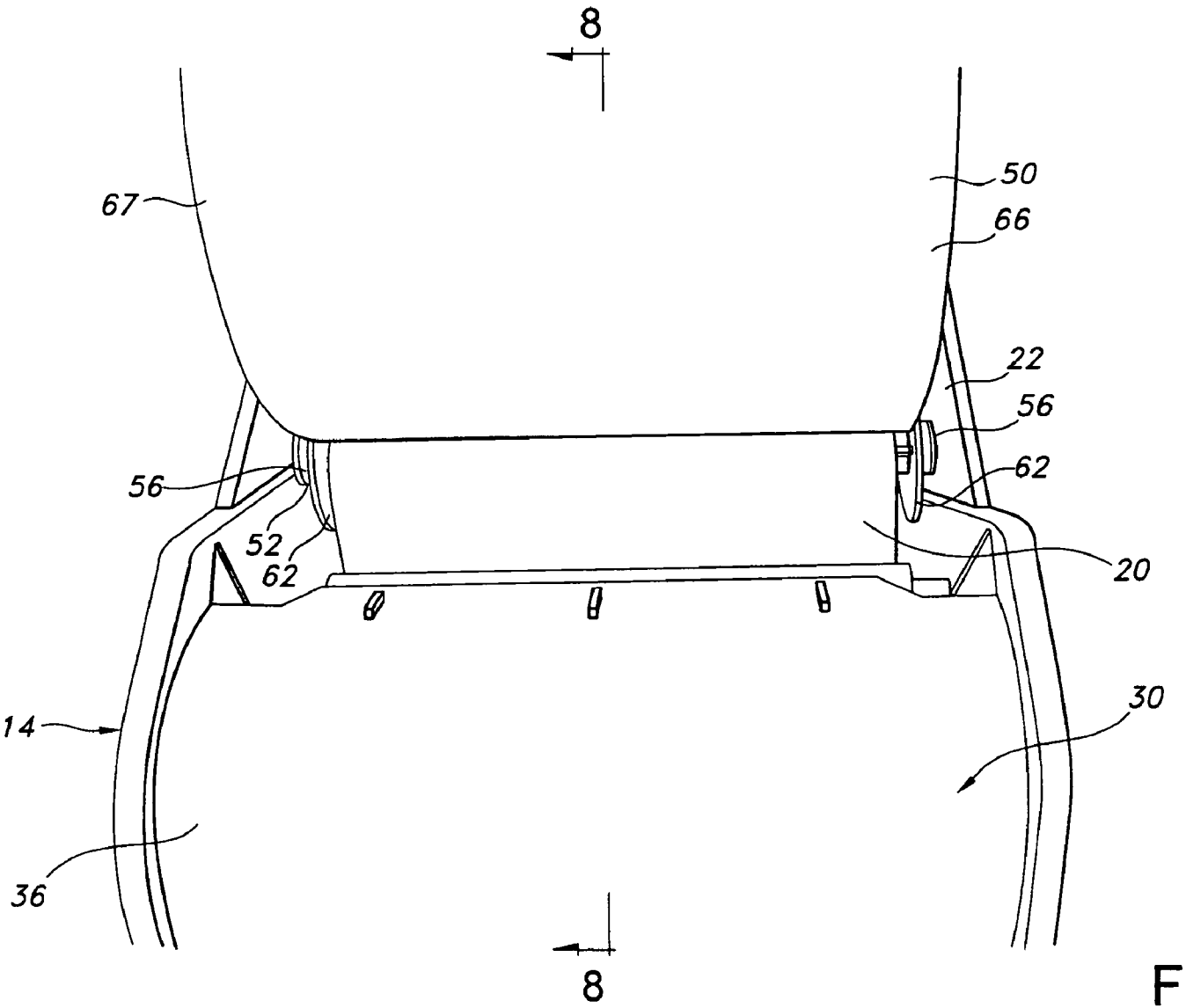
FIG. 6 is a front side view of the guide roller of FIGS. 4 and 5 positioned in the dispenser of FIG. 1, but showing sheet material flowing over the guide roller.
Figure 7:
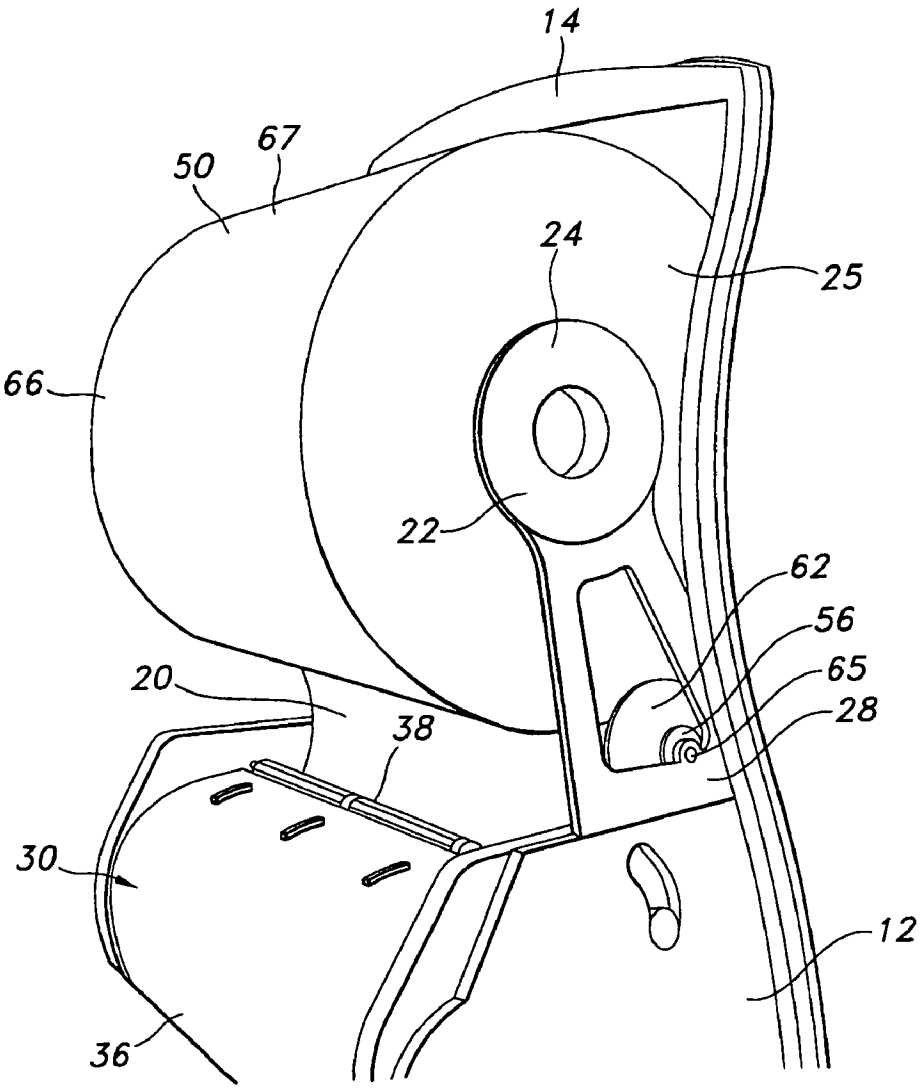
FIG. 7 is a side perspective view of the guide roller of FIGS. 4–6 positioned in the dispenser of FIG. 1, showing the rotationally coupled connection of the guide roller to an arm or a roll support

One prior art dispenser having a dispensing module or housing 12 is shown in FIG. 1. The dispensing module or housing 12 is desirably positioned in an outer paper towel dispenser cabinet 14 (portions of which are illustrated in FIGS. 5–7) and secured thereto by any suitable fasteners or mechanism(s).

A roll support 16 is operatively associated with the dispensing module 10 to rotatably support a cylindrical roll 18 of sheet material 20. The roll support 16 includes two double-ended arms 22 spaced-apart from one another and a roll engagement member 19 positioned at the distal or upper ends 24 of each arm 22 for engaging each flat end 25 and/or an opening 25' in the roll 12 and permitting rotation of the roll 18. The roll 18 is directly rotatably supported by the roll engagement members 19. The roll engagement member 19 may include a support roller (not shown).

The arms 22 are pivotally connected to the housing 12 by pivot connectors 26. The pivot connectors 26 are located at the lower ends 28 of the arms.

A dispensing assembly or a dispensing actuator roller assembly 30 is positioned within the housing 12 and spaced-apart from the roll support 18. The dispensing actuator roller assembly 30 receives the sheet material 20 from the roll 18 of sheet material 18. When the dispensing actuator roller assembly 30 is actuated by a user, it rotates in a predetermined direction to provide a single sheet of sheet material 20 to a user. The dispensing actuator roller assembly 30 desirably has a cylindrically-shaped outer peripheral portion 32 which includes strips of material 34 which are desirably parallel, spaced-apart channels which are covered by a curved toweling guide plate 36. A pivotably mounted cutter blade (not shown) is desirably mounted on the outer peripheral portion of the dispensing actuator roller. The blade is movable between a first position (not shown) in which the cutting edge of the place is positioned closely adjacent to the outer peripheral portion of the dispensing actuator roller and a second position (not shown) in which the blade is disposed at an angle relative to the outer peripheral portion with the cutting edge of the blade spaced from the outer peripheral portion of the dispenser actuator roller. The cutter blade when in the second position projects in a direction generally opposed to the direction of rotation of the dispenser actuator roller so that pulling force exerted on the sheet material by a user will bear against the cutting edge of the cutter blade to sever a single sheet from the sheet material (not shown).

A cylindrical member 38 may be provided with the dispensing actuator roller assembly 30 and it is desirably rotatably mounted between the side walls 40 of the housing 12 and positioned against the dispensing actuator roller assembly 30. Springs 42 desirably extend between the housing 12 and the ends 44 of the cylindrical member 38 to bias the cylindrical member 38 against the outer peripheral portion 32 of the dispensing actuator roller assembly 30 and form a nip therebetween (FIGS. 2, 3, 8 and 9). Other biasing apparatus, such as O-rings, bands, and so forth may be utilized as well. While the cylindrical member 38 may be considered as a separate element in the present embodiment, it will be understood that, alternatively, the cylindrical member 38 may be included as a portion of the dispensing assembly 30.

Figure 2:
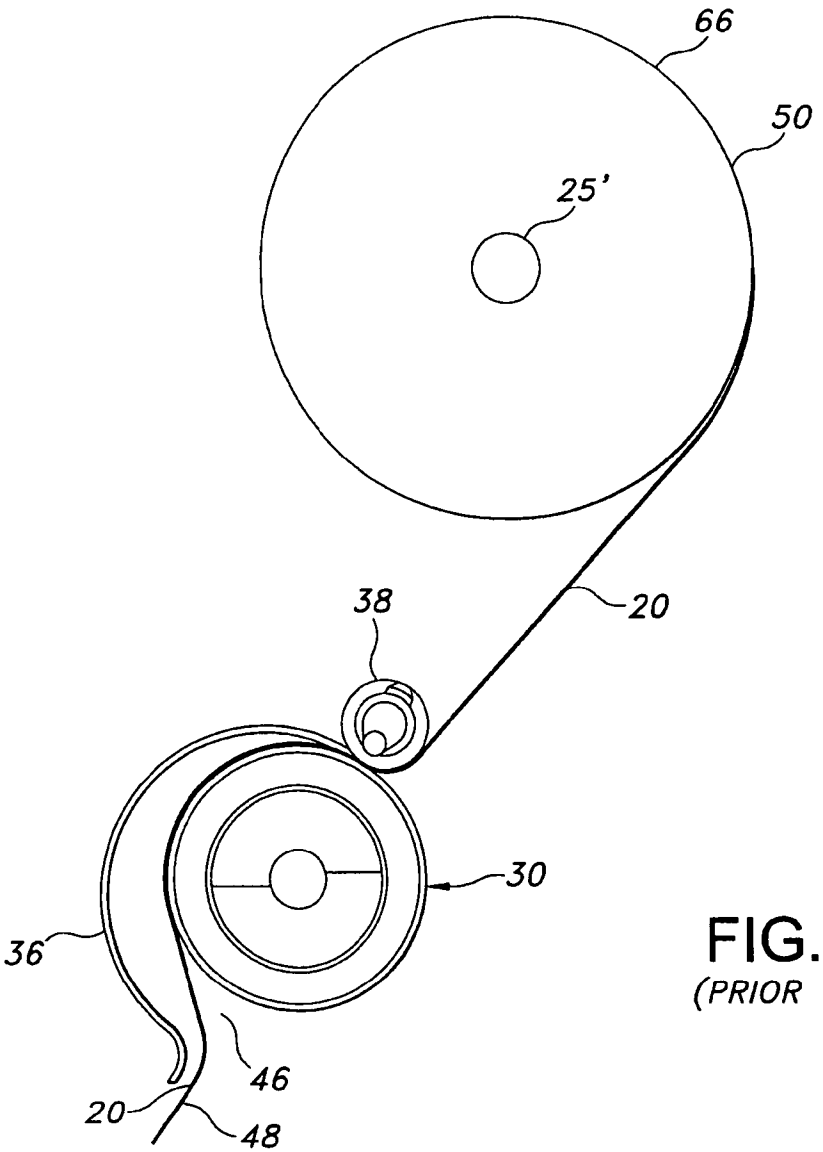
FIG. 2 (PRIOR ART)
FIG. 2 is a schematic cross sectional view of FIG. 1 taken along lines 2—2.

FIG. 2 illustrates a cross-sectional view of FIG. 1, showing the sheet material 20 flowing from a new roll 50, over the cylindrical member 38 through the nip and around a portion of the dispensing actuator roller assembly 30 and out an exit port 46. A tail 48 of the sheet material 20 desirably extends from the exit port 46 for a user to grasp for withdrawal of a single sheet of sheet material 20.

Problems, however, occur with this arrangement. The sheet material 20 from a roll 18, 50 (the number "18" applies to a roll having a number of sheets withdrawn therefrom; the number "50" applies to a new roll having fewer than three (3) sheets withdrawn therefrom) has room within the housing 12 and a tendency to move transversely therein. When this occurs, the sheet material 20 tends to bunch to one side or the other of the dispenser housing 12, and moves past the cylindrical member 38 and through the nip and against the dispensing actuator roller assembly 30 in this bunched condition. Such bunching of the sheet material 20 due to its displacement to one side of the housing 12 results in a jam of sheet material 20 within the dispensing actuator roller assembly and inadequate dispensing and/or dispensing failure. The sheet material 20, when bunched within the dispensing actuator roller assembly 30, may break off and/or tear within the dispensing actuator roller assembly 30. Such dispensing failure may result in a complete failutre, until maintenance personnel have cleared the blockage or jam. Therefore, FIG. 2 illustrates the ideal movement of the sheet material 20 from the roll 18, 50 past the cylindrical member 38 and through the dispensing actuator roller assembly 30 to the exit port 46. FIG. 3 illustrates the common displacement problem described above. When the sheet material 20 from the roll 18, 50 moves transversely, it bunches up and jams on one side of the housing 12. This bunching moves past the cylindrical member 38 into the nip and results in jamming of the sheet material 20 in the dispensing actuator roller assembly 30 and dispensing failure when sheet material is not available for withdrawal at the exit port 46 by a user.

Figure 4:
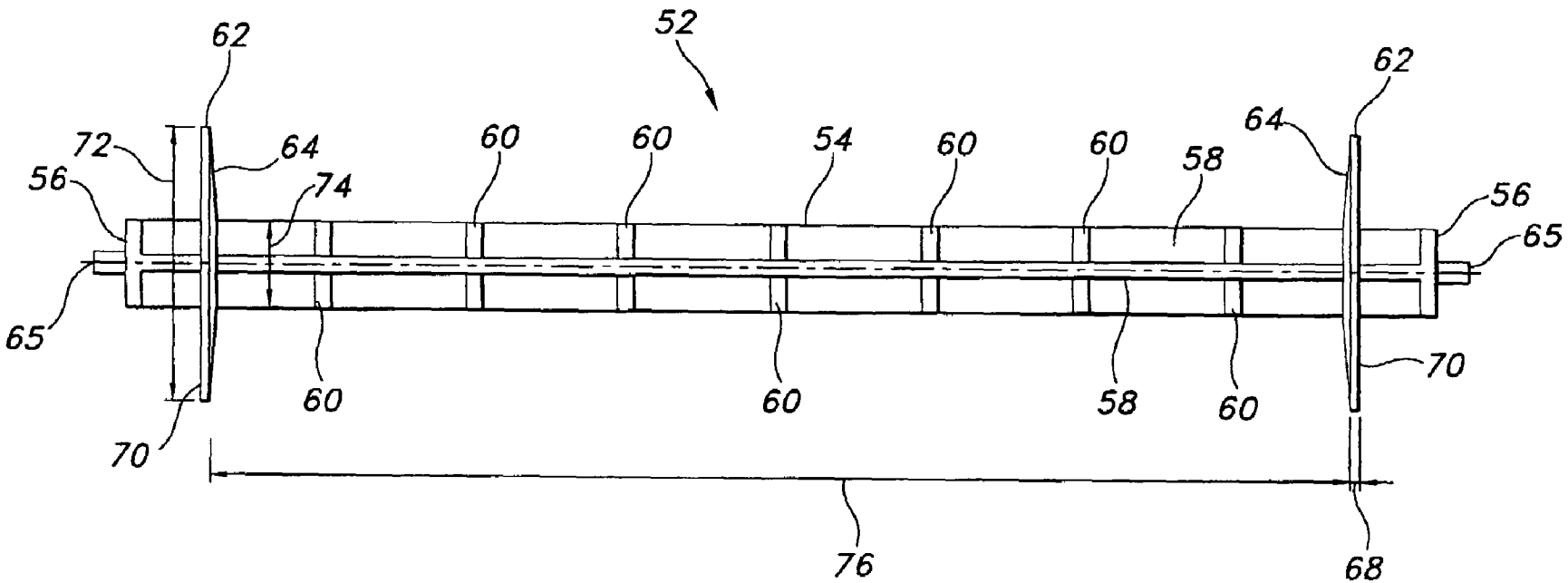
FIG. 4 is a side view of a guide roller of the present invention which may be used with a dispenser, such as the dispenser shown in FIG. 1.

As illustrated in FIGS. 4–9, the present invention uses a guide roller 52 to maintain the sheet material 20 in alignment with the cylindrical member 38 and/or the dispensing actuator roller assembly 30. As shown in FIG. 4, the guide roller 52 includes an elongated central portion 54 positioned between two ends 56. The central portion 54 may be constructed from two intersecting axially disposed plates 58 positioned generally at about a 90 degree relative to each other. The plates 58 may include a plurality of spaced-apart transversely disposed circular disks 60 positioned about or formed with the plates 56. The configuration of the central portion 54 is intended to be non-limiting; any configuration that operates as described may be used. Each end 56 desirably has a flange 62 positioned adjacent thereto. The flange 62 is desirably slightly tapered outward from an inner surface 64 positioned adjacent the sheet material 20, as illustrated best in FIG. 4. Each end 56 includes a pin 65 or similar apparatus which permits the guide roller 52 to be rotatably coupled to an aperture (not shown) in each arm 22 of the roll support 16.

Figure 8:
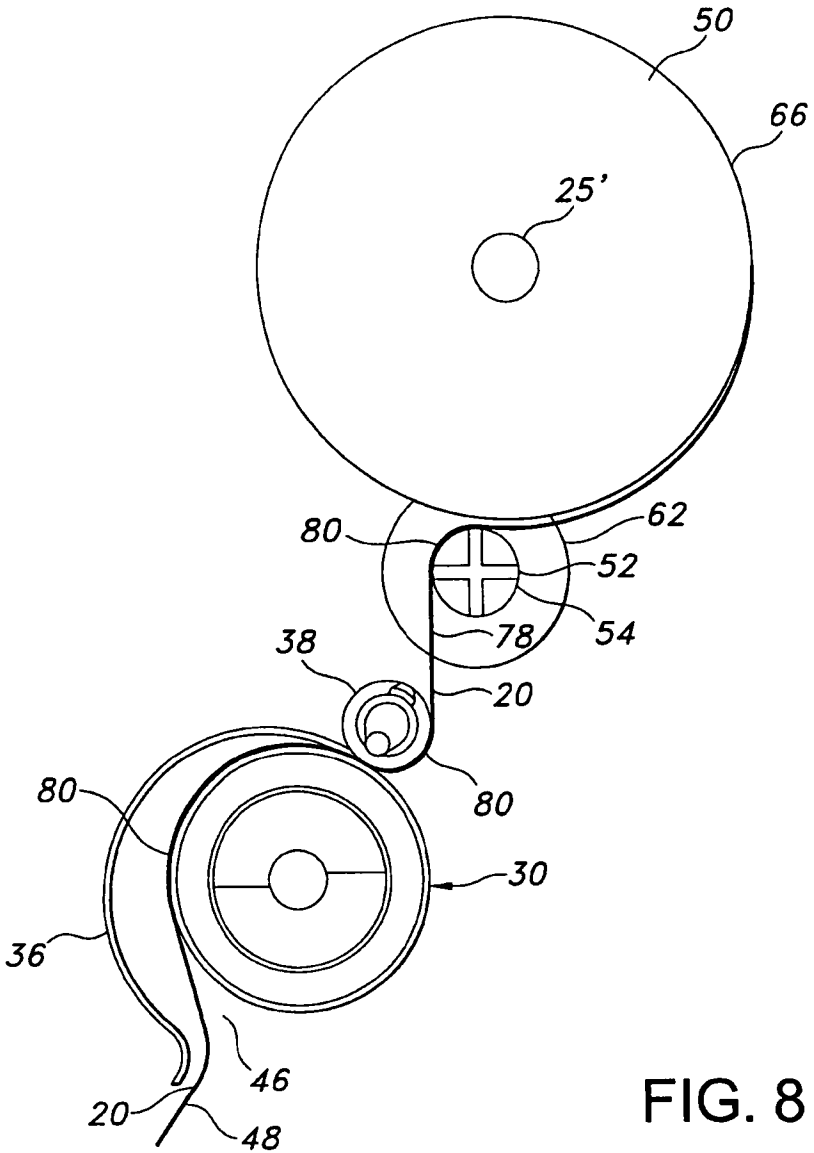
FIG. 8 is a schematic sectional view of FIG. 6 taken along lines 8—8.

The guide roller 52 is positioned closely adjacent and desirably against an outer circumference 66 defined by the cylindrical body 67 of the new roll 50 of sheet material 20, as illustrated in FIGS. 5–8. The guide roller 52 is desirably positioned such that sheet material 20 flows from the roll 50, 18 between the flanges 62 and over the central portion 54 of the guide roller 52 to the dispensing actuator roller assembly 30, the flow of sheet material 20 aligned on its path to the dispensing actuator roller assembly 30 such that bunching and jamming of non-aligned sheet material 20 is eliminated, and dispensing failure is greatly reduced or eliminated. The flange 62 positioned near each end 56 of the guide roller 52 is desirably positioned such that at least a portion of the inner surface 64 of the flange 62 is closely adjacent or against the flat surface 25 of each end of the new roll 50. In this manner, the flow of sheet material 20 is regulated from the roll 18, 50 to flow evenly and in alignment from the roll 18, 50 to the cylindrical member 38, through the nip and the dispensing actuator roller assembly 30 and through the exit port 46, as illustrated in FIG. 8. Such regulation and alignment reduces bunching of the sheet material 20 which results in jamming and/or dispensing failure from non-aligned sheet material. Without such alignment, as noted previously, the sheet material 20 may move transversely from the roll 18, 50 and/or other elements in the housing 12 into the dispensing actuator roller assembly 30, resulting, at times, in bunching, jamming and/or dispensing failure (FIG. 3).

Figure 9:
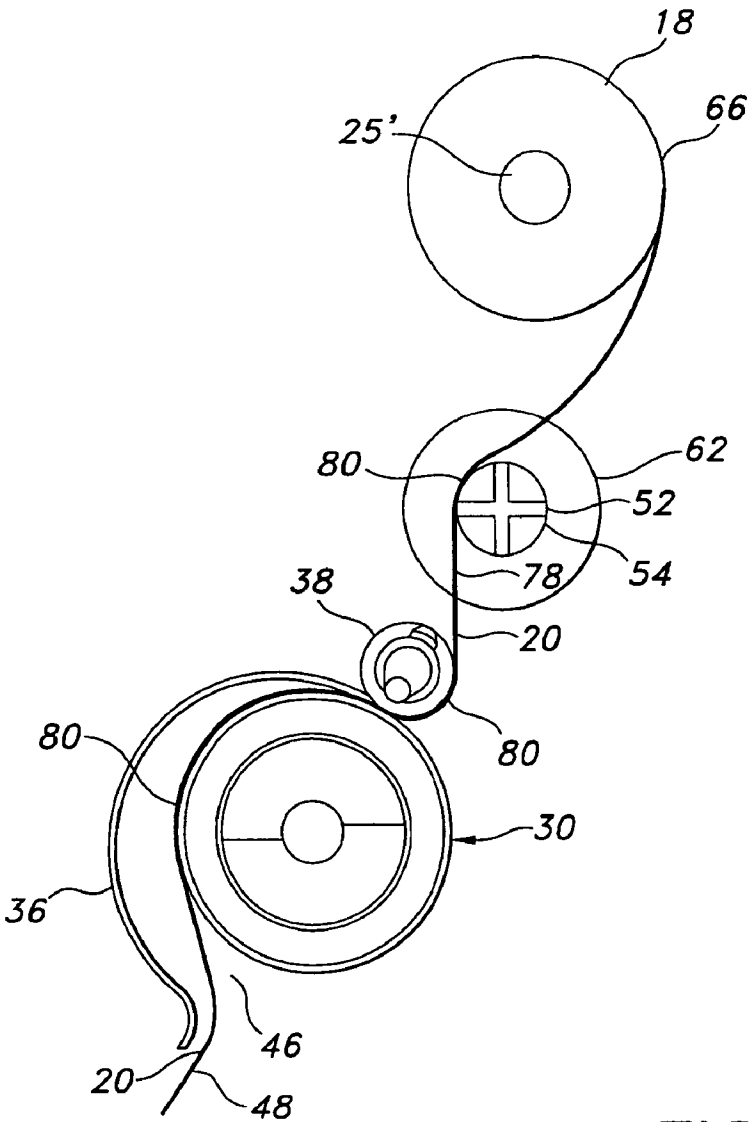
FIG. 9 is a schematic sectional view similar to FIG. 8, but showing a roll of sheet material which is partially depleted.

The guide roller 52 is maintained in a rotatable position relative to the roll 18, 50 and the cylindrical member 38, and it desirably rotates to facilitate flow of sheet material 20 thereover. The guide roller 52 is desirably adjacent or closely adjacent to the new roll 50 until the new roll 50 has dispensed about 100 sheets therefrom. It has been discovered that once the new roll 50 has been partially depleted by about 100 sheets and therefore reduced in size, the flanges 62 are not required to be positioned as closely to the flat surfaces 25 of the roll 18. In fact, the flat surfaces 25 similarly are reduced in size with depletion of the roll 18 and are therefore positioned near but do not touch the flanges 62, as shown in FIG. 9. Similarly, the central portion 54 of the guide roller 52 is positioned near but further away from the outer circumference 66 of the roll 18 as single sheets of sheet material 20 are withdrawn from the roll 18 and the roll is partially depleted. In this position, the central portion 54 does not touch the outer circumference 66 of the roll 18. The sheet material 20 continues to be maintained in alignment, however, as the sheet material 20 continues to flow between the flanges 62 and over the central portion 54 of the guide roller 52 until the roll 50, 18 is completely depleted and all sheet material 20 is withdrawn therefrom.

Turning back to FIG. 4, each flange 62 is tapered 68 outward from the inner surface 64 positioned adjacent the flat surface 25 of a roll 18 or new roll 50 to the outer surface 70 positioned adjacent the housing 12. The taper 68 of each flange 62 directs the sheet material into alignment with the dispensing actuator roller assembly 30. Such taper 68 is desirably between about 0.3 inches and 0.05 inches. More desirably, such taper is between about 0.2 inches and 0.5 inches. Even more desirably, such taper is between about 0.15 inches and 0.8 inches. Yet even more desirably, the taper is between about 0.1 inches and 0.01 inches.

Each flange 62 desirably has a diameter 72 in a range of about 0.5 inch to about 4.0 inches. Even more desirably, each flange has a diameter in a range of about 1.0 inch to about 3.0 inches. Yet even more desirably, each flange has a diameter of about 1.5 inches to about 2.5 inches.

Each central portion 54 of the guide roller 52 desirably has a diameter 74 of about 1.5 inches to about 0.25 inches. Even more desirably, central portion has a diameter of about 1.0 inch to about 0.35 inch. Yet even more desirably, each central portion has a diameter of about 0.8 inch to about 0.4 inch.

Each central portion 54 desirably has a length 76 between flanges 62 which permits it to be positioned closely adjacent or against an outer circumference 66 of a roll 50 of sheet material 20 without either flange 62 touching the outer circumference 66. Desirably, the length 76 of the central portion 54 permits each inner surface 64 of each flange 62 to be positioned closely adjacent to the flat surface 25 of the new roll 50. "Closely adjacent" as used herein relative to each flange 62 means that at least a portion of each inner surface 64 of each flange 62 is positioned within about 0.25 to about 0.02 inches from the flat surface 25 of the new roll 50. Alternatively, however, it will be understood that at least a portion of an inner surface 64 of at least one flange 62 may be positioned against a flat surface 25 of the new roll 50 or roll 18. "Closely adjacent" as used herein relative to the center portion 54 of the guide roller 52 means that at least a portion of the center portion 54 is positioned within about 0.5 to about 0.01 inches from the outer circumference 66 of the new roll 50. Alternatively, however, it will be appreciated that at least a portion of the center portion 54 of the guide roller 52 may be positioned against the outer circumference 66 of the new roll 50. "New roll" as used herein means a roll which is provided to the dispenser which has fewer then three sheets withdrawn from the roll 50. "Partially depleted roll" as used herein means a roll 18 having at least 100 sheets withdrawn from the roll 18.

It will be appreciated, as illustrated in FIGS. 8 and 9, that the sheet material 20 follows a serpentine path 78 from the roll 50, 18 to the exit port 46. This serpentine path 78 is desirably defined by three turns which are generally semi-circular turns 80 in the path 78. In this manner, the flow of sheet material 20 is regulated and aligned on its path 78 to the dispensing assembly 30 such that non-alignment of sheet material 20 is eliminated.

A tapered flange 62 is desirable. However, it will be appreciated that a flange without a taper may be used as an alternative embodiment (not shown).

While certain characteristics are described in specific embodiments, any one or more characteristics, features, and/or elements may be used in any combination in any embodiment, or to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An apparatus adapted for use with a dispenser housing for rolled sheet material to provide reliable dispensing of sheet material therefrom, the dispenser housing including a roll support configured to hold at least one cylindrical roll of sheet material and a dispensing assembly, the dispensing assembly including an exit port to permit sheet material to be withdrawn therefrom, the cylindrical roll of sheet material mounted on a portion of the roll support and the roll including opposing flat surfaces and an outer circumference, a cylindrical member spaced a distance apart from the roll support, the apparatus comprising:

a guide roller including an elongated central portion positioned between two opposing ends and a flange positioned near each end of the guide roller, wherein the central portion is configured to be positioned adjacent an outer circumference of a roll of sheet material when such a roll is a new roll disposed in the dispenser housing, and wherein at least a portion of an inner surface of each flange is positioned adjacent a flat surface of such a roll of sheet material when such a roll is a new roll, and when such a new roll becomes depleted of sheet material, it is positioned away from the guide roller by the removal of sheet material therefrom such that the guide roller does not touch an outer circumference of such a roll, the guide roller positioned such that sheet material flows from a roll between the flanges and over the central portion of the guide roller to the dispensing assembly, the flow of sheet material aligned on a path to the dispensing assembly such that non-alignment of sheet material is eliminated.

2. The apparatus of claim 1, wherein the sheet material follows a serpentine path from the roll to the exit port.

3. The apparatus of claim 2, wherein the serpentine path includes three semi-circular turns around three rollers in the path, each turn around a roller in an opposite direction relative to the turn next to it.

4. The apparatus of claim 1, wherein the guide roller is mounted to the roller support.

5. The apparatus of claim 4, wherein the guide roller rotates.

6. The apparatus of claim 1, wherein the flanges are positioned near flat surfaces of a partially depleted roll of sheet material.

7. The apparatus of claim 6, wherein the flanges do not touch flat surfaces of such a partially depleted roll of sheet material.

8. The apparatus of claim 1, wherein the taper of each flange directs the sheet material into alignment with the dispensing assembly.

9. An apparatus adapted for use with a dispenser housing for rolled sheet material to provide reliable dispensing of sheet material therefrom, the dispenser housing including a roll support configured to hold at least one cylindrical roll of sheet material and a dispensing assembly, the dispensing assembly including an exit port to permit sheet material to be withdrawn therefrom, the cylindrical roll of sheet material mounted on a portion of the roll support and the roll including opposing flat surfaces and an outer circumference, the apparatus comprising:

a guide roller positioned between a roll support and a dispensing assembly, the guide roller including an elongated central portion positioned between two opposing ends and a flange positioned near each end of the guide roller, wherein the central portion is configured to be positioned adjacent the outer circumference of a roll of sheet material when the roll is a new roll disposed in the dispenser housing, and wherein at least a portion of an inner surface of each flange is positioned adjacent a flat surface of the roll of sheet material when the roll is a new roll, the guide roller positioned such that sheet material flows from the roll between the flanges and over the central portion of the guide roller to the dispensing assembly, the flow of sheet material aligned on its path to the dispensing assembly such that non-alignment of sheet material is eliminated, the path comprising a serpentine path from the roll to the exit port wherein the serpentine path includes three semi-circular turns around at least three rollers in the path, each turn around a roller positioned in an opposite direction relative to the turn next to it.

10. The apparatus of claim 9, wherein the guide roller is mounted to the roller support, and the guide roller rotates.

11. The apparatus of claim 9, wherein the guide roller is positioned near a partially depleted roll of sheet material.

12. The apparatus of claim 11, wherein the central portion of the guide roller does not touch the outer circumference of the roll.

13. The apparatus of claim 9, wherein the flanges are positioned near flat surfaces of a partially depleted roll of sheet material.

14. The apparatus of claim 13, wherein the flanges do not touch flat surfaces of such a partially depleted roll of sheet material.

15. The apparatus of claim 9, wherein the taper of each flange directs the sheet material into alignment with the dispensing assembly.

16. A system adapted for use with a dispenser housing for rolled sheet material to provide reliable dispensing of sheet material therefrom; the system comprising:

a dispenser housing including a roll support configured to hold at least one cylindrical roll of sheet material and a dispensing assembly, the dispensing assembly including an exit port to permit sheet material to be withdrawn from the dispensing assembly and housing, a cylindrical roll of sheet material mounted on a portion of the roll support and the roll including opposing flat surfaces and an outer circumference; and a guide roller positioned between the roll support and the dispensing assembly, the guide roller including an elongated central portion positioned between two opposing ends and a flange positioned near each end of the guide roller, wherein the central portion is configured to be positioned adjacent the outer circumference of a roll of sheet material when such a roll is a new roll disposed in the dispenser housing, and wherein at least a portion of an inner surface of each flange is positioned adjacent a flat surface of the roll of sheet material when such a roll is a new roll, and such a roll becomes depleted of sheet material, it is positioned away from the guide roller by the removal of sheet material therefrom such that the guide roller does not touch an outer circumference of such a roll, the guide roller positioned such that sheet material flows from a roll between the flanges and over the central portion of the guide roller to the dispensing assembly, such a flow of sheet material aligned on a path to the dispensing assembly such that non-alignment of sheet material is eliminated.

17. The system of claim 16, wherein the sheet material follows a serpentine path from the roll to the exit port wherein the serpentine path includes three semi-circular turns around at least three rollers in the path, each turn around a roller positioned in an opposite direction relative to the turn next to it.

18. The system of claim 16, wherein the guide roller is mounted to the roller support, and the guide roller rotates.

19. The system of claim 16, wherein the flanges are positioned near flat surfaces of a partially depleted roll of sheet material.

20. The system of claim 19, wherein the flanges do not touch flat surfaces of such a partially depleted roll of sheet material.

21. The system of claim 16, wherein the taper of each flange directs the sheet material into alignment with the dispensing assembly.

* * * * *